United States Patent [19]

Suzuki

[11] Patent Number: 4,642,615

[45] Date of Patent: Feb. 10, 1987

[54] LIGHT-SCATTERING TYPE SMOKE DETECTOR

[75] Inventor: Takashi Suzuki, Tokyo, Japan

[73] Assignee: Nittan Company, Limited, Tokyo, Japan

[21] Appl. No.: 754,025

[22] Filed: Jul. 11, 1985

[30] Foreign Application Priority Data

Jul. 31, 1984 [JP] Japan ..... 59-159215
May 28, 1985 [JP] Japan ..... 60-113158

[51] Int. Cl.[4] ..... G08B 17/10
[52] U.S. Cl. ..... 340/630; 250/574; 356/439
[58] Field of Search ..... 340/630; 250/574; 356/439

[56] References Cited

U.S. PATENT DOCUMENTS

| | | | |
|---|---|---|---|
| 3,383,670 | 5/1968 | Roberts | 340/630 |
| 3,409,885 | 11/1968 | Hall | 340/630 |
| 4,166,698 | 9/1979 | Steele | 340/630 X |
| 4,242,673 | 12/1980 | Cooper | 340/630 |

OTHER PUBLICATIONS

"Color Technology and Its Applications in Industry"; published in Feb. 1970 by Diano Corporation; authored by W. A. Coppock et al.; pp. cover, 1 and 17.

*Primary Examiner*—James L. Rowland
*Assistant Examiner*—Daniel Myer
*Attorney, Agent, or Firm*—Webb, Burden, Robinson & Webb

[57] ABSTRACT

In the light-scattering type smoke detector with a disorder detecting circuit, the Munsell value of lightness of the inside surface of the dark chamber is raised to 2–4. Thereby, not only disorder of the apparatus but also performance drop of apparatus parts can be detected.

4 Claims, 3 Drawing Figures

LIGHT-SCATTERING TYPE SMOKE DETECTOR

FIELD OF THE INVENTION

This invention relates to a novel light-scattering type smoke detector. More particularly, this invention relates to a light-scattering type smoke detector, which is provided with a function to detect disorder or malfunction of the detector by sensing the base level noise light (background) when there exists no smoke.

BACKGROUND OF THE INVENTION

The light-scattering type smoke detector is an apparatus which comprises a dark chamber into which smoke can enter and wherein a light-emitting element and a light-receiving element are disposed at positions where the light beam from the light-emitting element does not directly impinge in the light-receiving element, and which by sensing scattering of light caused by the minute particles of any smoke which enters the dark chamber, generates a fire alarm or the like. There is known a smoke detector of this type which is adjusted so that the base level noise light (background) can be sensed, whereby the detector generates a malfunction signal when the base level noise light is not detected (Laid-Open Utility Model Publication No. 32183/84, Laid-Open Patent Publication No. 21511/84, etc.).

Generally, the inside surface of the dark chamber (usually of a labyrinth structure) which smoke can enter is matte black, because the lower noise light, the better. That is, the background level is very low.

Even with such low background, breakage of a light-emitting element, disconnection, etc. can satisfactorily be detected, but a condition such as deterioration of a light-emitting element caused by aging, etc. cannot easily be detected with such low background.

In this case, if the inside surface of the dark chamber is made light, that is, if the inside surface is brightened, the background (base level noise light) is increased, and therefore, deterioration in the performance of apparatus parts can more easily be detected. But, as the noise level is raised, the difference between signal and noise decreases and thus inaccuracy in alarm generation is invited.

We studied how output of the light-receiving element changes when lightness of the inside surface of the dark chamber is raised, and we found that if the Munsell value of lightness of the inside surface of the dark chamber is raised up to 2–5, detection of smoke is not substantially influenced contrary to the general conviction. No one has considered venturing to raise the lightness of the inside surface of the dark chamber.

DISCLOSURE OF THE INVENTION

This invention provides a light-scattering type smoke detector which comprises a dark chamber of a labyrinth structure, a light-emitting element and a light-receiving element provided in the dark chamber at positions where the light beam from the light-emitting element does not directly impinge on the light-receiving element; and detects the existence of smoke by sensing the scattering of light caused by minute particles of smoke, which enters the dark chamber by the light-receiving element and thus generates an alarm, said detector being provided with a malfunction detecting circuit; characterised in that the Munsell value of lightness of the inside surface of the dark chamber is adjusted to be 2–4.

Preferably, the Munsell value is adjusted to be 2.5–4. More preferably it is adjusted to be 3–3.5.

The color of the inside surface may be achromatic (gray to black) or chromatic. The dark chamber casing may be made of a colored plastic material or may be coated with colored material.

The principle of the present invention is applicable to both analog and digital systems. Practically analog system is preferred. The invention will now be described in detail with reference to the attached drawings.

BRIEF DESCRIPTION OF THE ATTACHED DRAWINGS

SPECIFIC DESCRIPTION OF THE INVENTION

Figure 1:
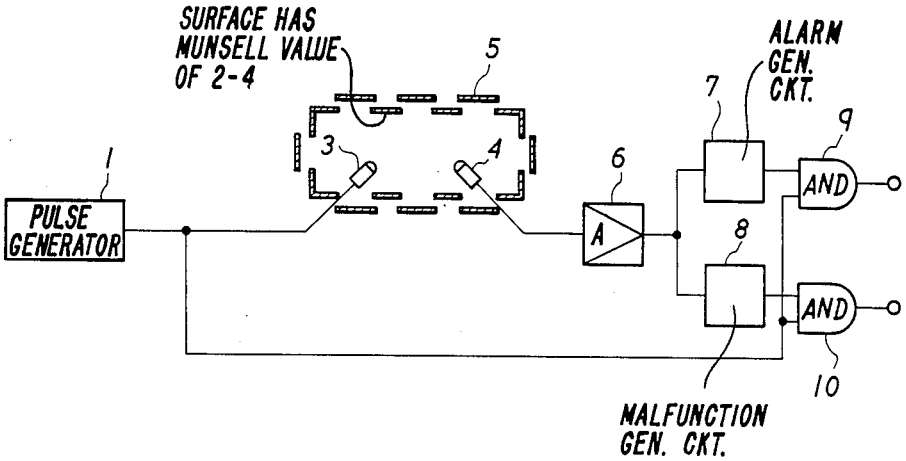
FIG. 1 is a simplified schematic presentation of the conception of the light scattering type smoke detector with a malfunction detection circuit.

As shown in FIG. 1, the detector comprises a pulse generation circuit 1, a dark chamber of labyrinth structure 5, a light-emitting element 3 provided in the dark chamber, a light-receiving element 4 provided in the dark chamber at a position where the light beam from the light-emitting element does not directly impinge upon it, an amplifier 6 which amplifies the output of the light-receiving element, a fire alarm generation circuit 7 which generates a signal when an output in excess of a pre-determined level is applied to the amplifier, a malfunction signal generation circuit 8 which generates a signal when an output lower than another pre-determined level is applied to the amplifier 6, and AND gates 9 and 10 which output in accordance with the logical product of the output of the pulse generation circuit 1 and that of the signal generation circuits 7 and 8 respectively. In the technical idea of this invention, the pulse generation circuit is dispensable. Also the detector may be constructed so that the output of the amplifier 6 is transmitted to a remote receiving unit through a transmission line and the receiving unit determines whether it comes from smoke or malfunction.

Usually a smoke detector of this kind is designed so that it generates an alarm at a smoke concentration of 6–15%/m (a concentration which dims a light beam by 6–15% per 1 m of optical path), and the S/N ratio is about 4.

Figure 2:
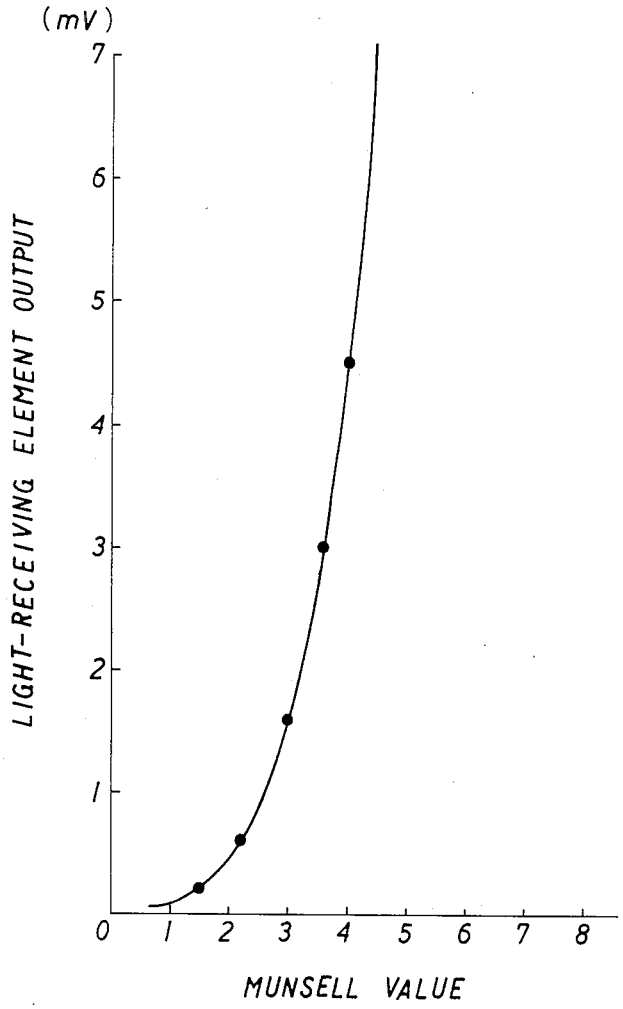
FIG. 2 is a graph which shows change in the light-receiving element output when Munsell value is increased.

Generally, when the Munsell value of the lightness of the inside surface of the dark chamber is raised, output of the light-receiving element increases parabolically. FIG. 2 shows the change of the light-receiving unit output of a smoke detector ("2KC" smoke detector manufactured by Nittan Company) when the Munsell value of the inside surface thereof is raised. This means a steep rise in the noise (background). However, it is expected that the existence of smoke will work to cancel this effect.

While there is no means of separately detecting background and smoke in the dark chamber when both exist, we checked the relation between the two as quantitatively as possible with respect to the detector with which the data of FIG. 2 was collected. Dark chamber casings of Munsell values of 1.5, 2.2, 3.0, 3.6, 4 and 5 were prepared, and outputs of the light-receiving element when the respective casings were mounted and when there existed smoke of a 10% concentration for each casing were measured.

TABLE 1

| Munsell value | Output of light-receiving element with no smoke (mV) A | Output of light-receiving element with 10%/m smoke (mV) B | Noise value with 10%/m smoke (mV) C | output caused by smoke = B − C (mV) |
|---|---|---|---|---|
| 0 | 0 | 2.40 | 0 | 2.40 |
| 1.5 | 0.20 | 2.60 | 0.20 | 2.40 |
| 2.2 | 0.60 | 3.00 | 0.59 | 2.39 |
| 3.0 | 1.60 | 3.87 | 1.57 | 2.37 |
| 3.6 | 3.00 | 5.30 | 2.94 | 2.36 |
| 4.0 | 4.50 | 6.72 | 4.41 | 2.31 |
| 5.0 | 60.00 | 61.20 | 58.81 | 1.20 |

In the above table, the Munsell value 0 is the lightness when the detector without a dark chamber casing is placed in a darkroom, that is, when there is no background. The noise (background) value (C) when 10%/m of smoke exists is the value of the light receiving element output (A) multiplied by 0.98. The reason therefor is as follows. It can not be distinguished how much of the light-receiving element output when smoke exists arises from the scattering effect of the smoke and how much arises from the background (noise) which is attenuated by smoke. However, it is known from calculation that the background attenuation by 10%/m smoke is around 2%. The base of the calculation is as follows. The used dark chamber is of the size of about 5 cm in diameter and the light beam from the light-emitting element enters the light-receiving element mostly after being reflected 3–4 times by the wall of the dark chamber, and the length of the optical path of the beam is, therefore, about 20 cm or so. The obscuration effect can be calculated in accordance with the Lambert's law:

$$O_d = \left[1 - \left(1 - \frac{O_u}{100}\right)^d\right] \times 100\ (\%)$$

Wherein $O_d$ is light obscuration at distance d, d is optical path (in meters), and $O_u$ is light obscuration per meter. In this case, d=0.2 m, $O_u$=10%/m. Therefore, $O_u$ = 10%/m. Therefore, $$O_d = \left[1 - \left(1 - \frac{10}{100}\right)^{0.2}\right] \times 100 = 2.085\%/20\text{ cm}$$

$$\approx 2\%/20\text{ cm}$$

It was found that background obscuration effect of smoke is smaller than anticipated up to a Munsell value of about 4 and a smoke concentration of 10%/m. Also it was found that this effect becomes almost negligible if the S/N ratio is raised.

Figure 3:
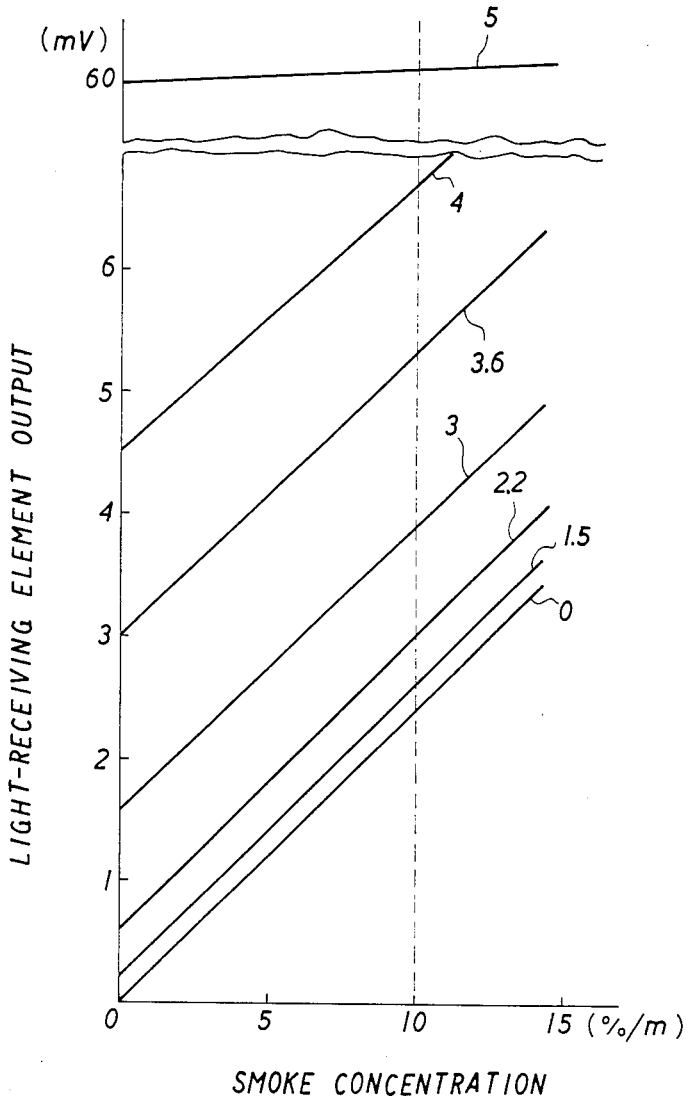
FIG. 3 is a graph which shows the relation between smoke concentration, light-receiving element output and different Munsell values of the same detector.

The results of measurement of light-receiving element outputs with respect to various levels of the background and smoke concentration are indicated in FIG. 3. Line 0 indicates the case when the Munsell value is 0, line 1.5 indicates the case when the Munsell value is 1.5 ("2KC" smoke detector manufactured by Nittan Company), line 2.2 when the Munsell value is 2.2, line 3 when the Munsell value is 3, line 3.6 when the Munsell value is 3.6, line 4 when the Munsell value is 4, and line 5 stands when the Munsell value is 5.

As the lightness increases, the line rises less steeply, and the distance between the lines increases geometrically. However, a substantially parallel relation is maintained up to a Munsell value of about 4 and it was found that it is possible to raise the Munsell value of the dark chamber of the detector now used by adjustment of the alarm-generating output, without substantial modification of the detector system now employed.

WORKING EXAMPLE

A dark chamber casing of a Munsell value of 2.2 was mounted on a smoke detector (the above-mentioned "2KC" in which a light-emitting element (a light-emitting diode "OLD-2203" manufactured by Oki Denki K. K.) and a light-receiving element (a photodiode "NJL612B" manufactured by New Japan Radio Co. Ltd.) are used and the system was designed so that 2.4 mV is output at a smoke concentration of 10%/m.

The thus adjusted smoke detector generated an alarm without fail at a smoke concentration of 10%/m and detected deterioration of a light-emitting element caused by aging, which conventional smoke detectors are not capable of.

Although the invention is based on a simple idea, the conceptional shift should be duly evaluated which brought about an enhancement of the failure detection ability of a smoke detector.

What we claim is:

1. A light-scattering type smoke detector which comprises a dark chamber of a labyrinth structure, a light-emitting element and a light-receiving element provided in the dark chamber at positions where the light beam from the light-emitting element does not directly impinge on the light-receiving element; wherein the light-receiving element detects the existence of smoke by sensing the scattering of light caused by minute particles of smoke entering the dark chamber and generates an alarm, said detector including means for detecting malfunctions of said light-receiving element; wherein the Munsell value of lightness of the inside surface of the dark chamber is in the range of 2–4.

2. The light-scattering type smoke detector as described in claim 1, wherein the Munsell value of lightness of the inside surface of the dark chamber is in the range of 2.5–4.

3. The light-scattering type smoke detector as described in claim 2, wherein the Munsell value of lightness of the inside surface of the dark chamber is in the range of 3–3.5.

4. The light-scattering type smoke detector as described in claim 1, wherein the dark chamber casing is made of a colored plastic.

* * * * *